US007331484B2

(12) United States Patent
Kerr

(10) Patent No.: US 7,331,484 B2
(45) Date of Patent: Feb. 19, 2008

(54) FLUID DISPENSING DEVICE

(75) Inventor: Peter R Kerr, Sydney (AU)

(73) Assignee: Macnaught Pty Limited, Turrella (AU)

( * ) Notice: Subject to any disclaimer, the term of this patent is extended or adjusted under 35 U.S.C. 154(b) by 441 days.

(21) Appl. No.: 11/001,087

(22) Filed: Dec. 2, 2004

(65) Prior Publication Data

US 2006/0027594 A1 Feb. 9, 2006

(30) Foreign Application Priority Data

Dec. 5, 2003 (AU) ..... 2003906761

(51) Int. Cl.
*B67D 5/06* (2006.01)

(52) U.S. Cl. ..... 222/23; 222/14; 222/33

(58) Field of Classification Search ..... 222/14, 222/16–20, 23, 33; 235/61 M, 132 R, 132 A, 235/91 R; 74/523–526; 141/392
See application file for complete search history.

(56) References Cited

U.S. PATENT DOCUMENTS 2,046,304 A * 6/1936 Brubaker et al. ..... 235/132 R
2,137,013 A * 11/1938 Bradley ..... 235/132 A
2,265,325 A * 12/1941 Steen ..... 235/132 R
2,322,712 A * 6/1943 Hazard ..... 235/132 A
3,000,541 A * 9/1961 Sonnenburg et al. ..... 222/20
3,260,409 A * 7/1966 Benham, Jr. ..... 222/20

* cited by examiner

*Primary Examiner*—J. Casimer Jacyna
(74) *Attorney, Agent, or Firm*—Steptoe & Johnson LLP

(57) ABSTRACT

A fluid dispensing device of the type, including a shut off valve means for controlling fluid flow through the device and an actuating trigger operable to cause the shut off valve to adopt an open position in which fluid can be dispensed from the device and a closed position, a control meter which enables the volume of fluid being disposed to be measured, a latching mechanism operable to hold the shut off valve in the open position and cause the shut off valve to adopt the closed position when the predetermined volume of fluid has been dispensed, and a setting mechanism being operatively connected to the control meter for indicating a predetermined volume of fluid required to be dispensed and indicating when that predetermined volume has been dispensed.

20 Claims, 10 Drawing Sheets

SCALE 1:2

FLUID DISPENSING DEVICE

FIELD OF INVENTION

This invention relates generally to fluid dispensing devices for controlling the flow of fluid therefrom and components therefor.

BACKGROUND OF INVENTION

One particular application of the present invention is in the automotive industry where oil is stored in a bulk tank and supplied to a work area through for example a pipe system and hose reel. The fluid dispensing device permits the amount of oil being dispensed to be controlled. It will be readily apparent to those persons skilled in the art that the dispensing device of the present invention could be used in a variety of applications and as such reference to the aforementioned particular application is not to be taken as a limitation on the scope of the present invention.

Fluid dispensing devices for controlling the discharge of fluid are known. Generally such devices include a control valve and meter through which fluid to be dispensed is passed and a display providing a reading of the quantity of fluid dispensed and/or required to be dispensed. In some currently known dispensing devices the required amount of fluid to be dispensed can be indicated on the display. The device can thereafter be activated so that fluid can be discharged from the device until the selected amount of fluid has been discharged. Once this has been achieved the device is adapted so as to stop the flow of fluid being discharged.

Known devices include electronic systems by which the quantity of fluid required to be dispensed can be set and subsequently stopped. A problem with electronic systems is that they can be relatively expensive and prone to damage particularly where the environment of use leads to rough handling of equipment. Mechanical systems have also been proposed but these are usually in the form of a settable rotary dial which have a limited accuracy.

It is an object of the present invention to provide an improved dispensing device which alleviates one or more of the aforementioned disadvantages.

SUMMARY

The present invention is concerned with a fluid dispensing device of the type, including a shut off valve means for controlling fluid flow through the device and an actuating trigger operable to cause the shut off valve to adopt an open position in which fluid can be dispensed from the device and a closed position, a control meter which enables the volume of fluid being disposed to be measured, a latching mechanism operable to hold the shut off valve in the open position and cause the shut off valve to adopt the closed position when the predetermined volume of fluid has been dispensed, and a setting mechanism being operatively connected to the control meter for indicating a predetermined volume of fluid required to be dispensed and indicating when that predetermined volume has been dispensed.

According to one aspect of the present invention there is provided a setting mechanism suitable for use in a fluid dispensing device of the type described above the setting mechanism including a plurality of display wheels which can indicate the predetermined quantity of fluid to be dispensed. The display wheels are operatively connected to the control meter so that the flow of fluid through the control meter can be displayed on the display wheels. The arrangement is such that when the shut off valve is in the closed position the display wheels can be adjusted to indicate the predetermined quantity of fluid to be dispensed and when the shut off valve is opened the display wheels can indicate when the predetermined volume has been dispensed. The setting mechanism includes a plurality of setting wheels each setting wheel being associated with a respective one of the display wheels, each setting wheel being operatively connectible with the display wheel with which it is associated via a gear train, each setting wheel being mounted for movement between an engaged position and a disengaged position.

In the engaged position each setting wheel is operatively connected to the display wheel with which it is associated via the gear train so that rotation of the setting wheel causes rotation of the display wheel with which it is associated. In the disengaged position the setting wheel is disconnected from the display wheel with which it is associated and may be freely rotatable.

The setting mechanism may include a support frame to which the setting wheels and display wheels are operatively mounted.

Each setting wheel may be operatively mounted to a pivot member which is pivotally connected to the support frame, so that pivotal movement of the pivot member causes movement of the setting wheel between the engaged and disengaged positions.

There may further be provided spring means for urging each setting wheel into the disengaged position. The spring means may be in the form of a generally resilient leg on the pivot member.

According to another aspect of the invention there is provided a latching mechanism suitable for use in a fluid dispensing device of the type described above either in its broadest form or more specific forms the latching mechanism including a latch setting assembly for setting the actuating trigger of the device so that the shut off valve is in the open position, a trip assembly which is actuatable at a preselected display on the display wheels of the setting mechanism, a first catch assembly operable so as to adopt an engaged position or a disengaged position and arranged such that actuation of the trip assembly causes the first catch assembly to adopt the disengaged position, and a second catch assembly which can adopt an engaged position when the actuator trigger of the device is in an actuating position in which the shut off valve is open, the first catch assembly adopting the engaged position when the actuator trigger is moved to the actuating position.

The latch setting assembly may include a setting button mounted on the actuator trigger, and a connector arm operatively connected to the button.

The first catch assembly may include a control member which is pivotally mounted to a part of the body portion of the trigger. The control member may include a catch and push element adapted to cooperate with a latch member. The latch member may be in the form of a latching plate pivotally mounted to the housing at a pivot mounting. The catch assembly may include first and second latching sections defined by shoulders formed as edges of apertures in the latching plate.

The second catch assembly may include a catch member having a catch thereon which is operatively connected to a trip assembly. A spring may act on the catch member.

The trip assembly may include a trip pin actuatable by a boss on one of the display wheel. A coupling member is caused to be moved by the trip pin whereupon it is engaged by an activating projection on another display wheel.

The latching mechanism is operable so as to be able to adopt a latched position in which position the valve of the dispensing device is open and a release position in which the valve can return to a closed position. Preferably the trigger can be activated to cause the valve to open whether or not the latch mechanism is in the latched position.

To set the latching mechanism the trigger is depressed. This causes rotation of the shaft and cam surface which acts on the valve follower to cause the valve to open. The rotational movement of the trigger body moves the control member into engagement with the latch plate. The latch plate is pivotal about its pivot mounting causing the catch to engage with first latching section on latch plate. At this stage the catch is not engaged with latching section and the trigger can return to its first position under the influence of a spring.

To set the trigger it is moved to its second position causing a pivotal movement of the control member and depression of the button causes arm to engage the end of the control member so that the catch engages latching section thereby holding the trigger in the second position.

The setting mechanism enables a volume to be set correlating to three display wheels. For example, the device can be set to read tenth increments, unit increments and decade increments. The selected volume is set by pressing and rotating to the selected reading each of the thumb wheels each of which is associated with a respective display wheel. When moved the thumb wheels disengage from the other wheels so that they can be separately set without interference from the other wheels. All wheels can be rotation in both directions.

When the trigger is moved to the second position and the latch mechanism set fluid can flow through the meter and the display wheels will rotate counting down towards zero. When the meter reaches zero the valve latch is released and the flow stops.

In accordance with other aspects of the present invention there is provided a fluid dispensing device of the type described above.

BRIEF DESCRIPTION OF DRAWINGS

Preferred embodiments of the invention will hereinafter be described with reference to the accompanying drawings, and in those drawings:

FIGS. 2(*a*) and 2(*b*) are views from different positions of a connection between part of a setting mechanism and a calibrating gear box which form part of the fluid dispensing device shown in FIGS. 1 and 2;

DETAILED DESCRIPTION

Figure 1:
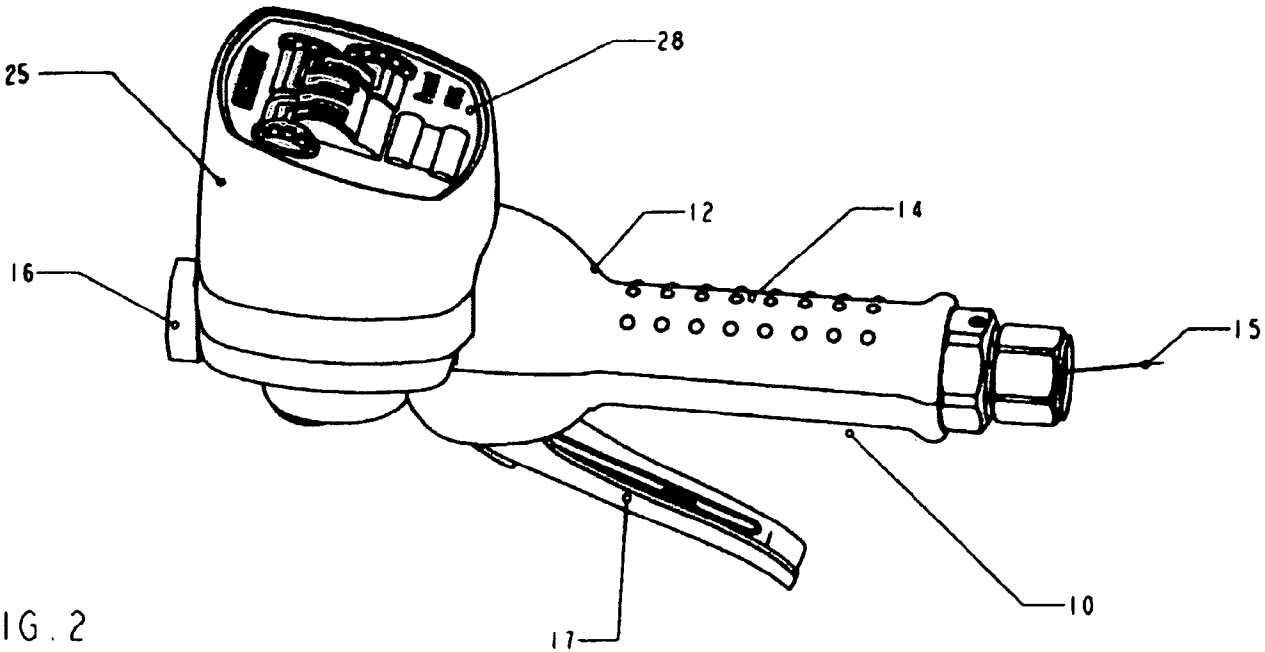
FIG. 1 is a perspective view of a fluid dispensing device according to the present invention.
Figure 2:
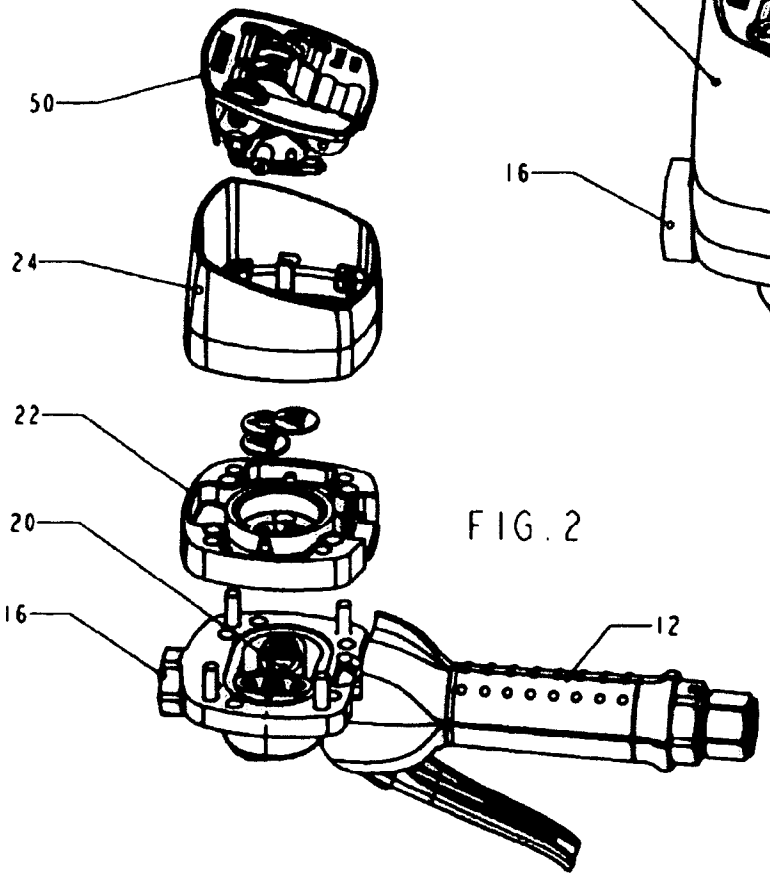
FIG. 2 is an exploded view of the device shown in FIG. 1.

Referring to FIGS. 1 and 2 there is shown a fluid dispensing device 10 which includes a main body 12 having a handle 14, an inlet 15 which is connectible to a hose (not shown) from which fluid is delivered to the device and an outlet 16 to which a nozzle (not shown) can be attached for discharging fluid from the device 10. The device further includes a trigger 17 operable so that it can adopt first and second positions which causes a valve 18 (FIG. 19 to 23) to open or close. With reference to FIGS. 19 to 23 the trigger includes a body portion 26 to which a pivot shaft 27 is mounted. The pivot shaft 27 includes cam section 28 in the form of a flat side face on the pivot shaft 27 which acts against an extension or follower 19 of the valve 18. A spring 29 urges the valve 18 into its closed position. The trigger is pivotally movable from the first position (FIG. 19) in which the valve 18 is closed to the second position (FIG. 20) in which the valve 18 is open. To open the valve 18 the cam section 28 acts on the free end of the valve extension 19 when the trigger 17 moves into the second position (see FIG. 20). A spring (not shown) urges the trigger 17 into the first position. In use when the trigger 17 is in the second position fluid can flow through the device 10 from the inlet 15 to the outlet 16. The device further includes a constant volume control meter 20 which measures the flow of fluid therethrough, a calibrating gear box 22 operatively connected to the control meter 20 and a setting mechanism 50 which can be set a predetermined volume so that the valve 18 will be closed upon actuation of a latching mechanism which is triggered when the predetermined volume of fluid has passed through the device. The setting mechanism is housed within a casing 24 and a protective rubber boot (not shown) surrounds the main body of the device.

The present invention is concerned in particular with the improved setting mechanism and/or the associated latching mechanism. There are several new and distinct aspects of these mechanisms which may constitute separate and distinct inventions in their own right.

The Setting Mechanism

Figure 3B:
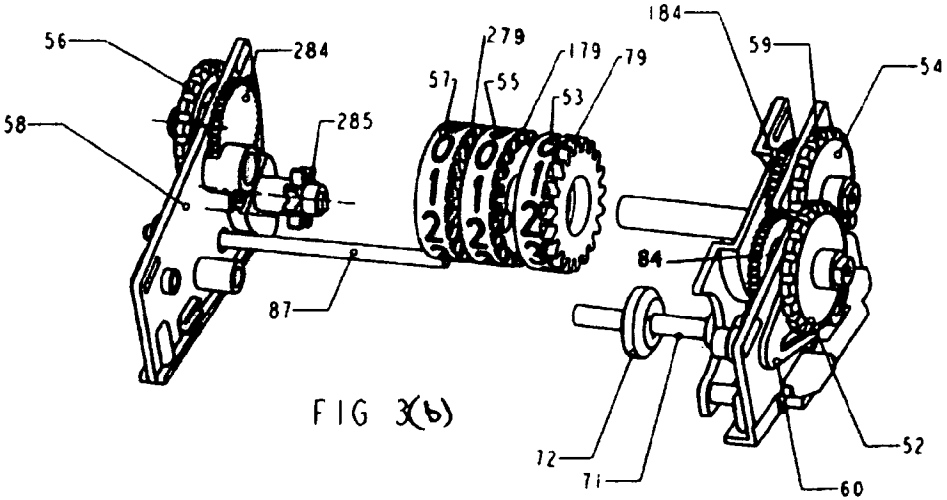
FIGS. 3(*a*) and 3(*b*) are exploded perspective views of a setting mechanism which forms part of the device shown in FIGS. 1 and 2.
Figure 3A:
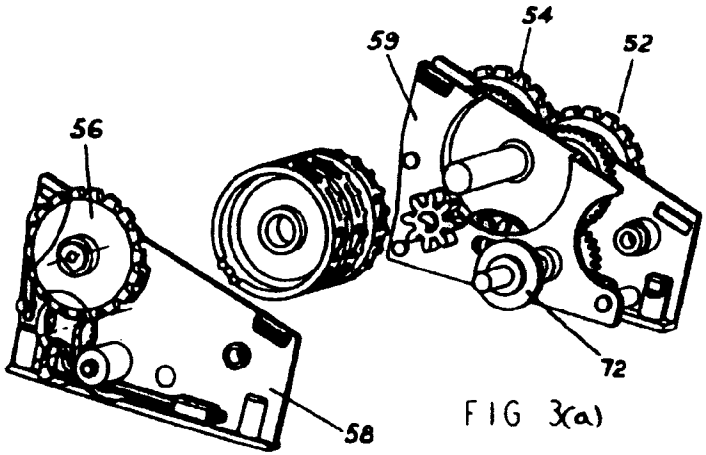
Figure 2B:
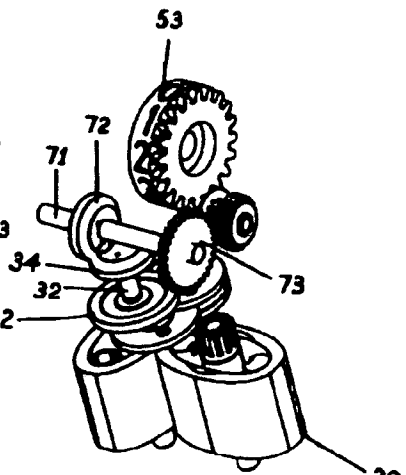
Figure 2A:
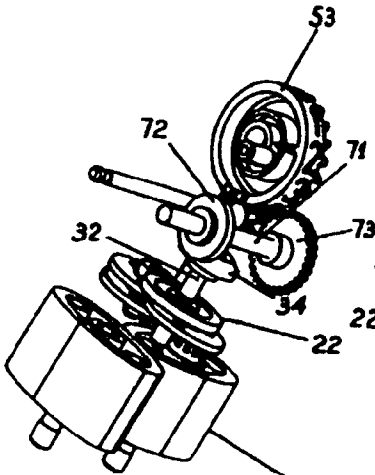
Figure 5:
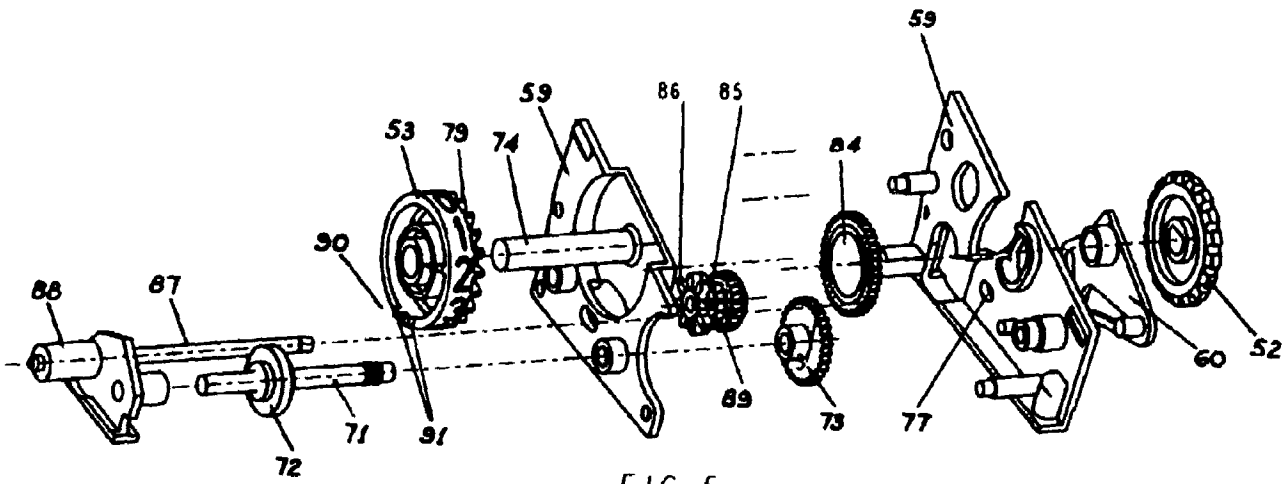
FIG. 5 is a detail of another part of the setting mechanism shown in FIG. 3.
Figure 7:
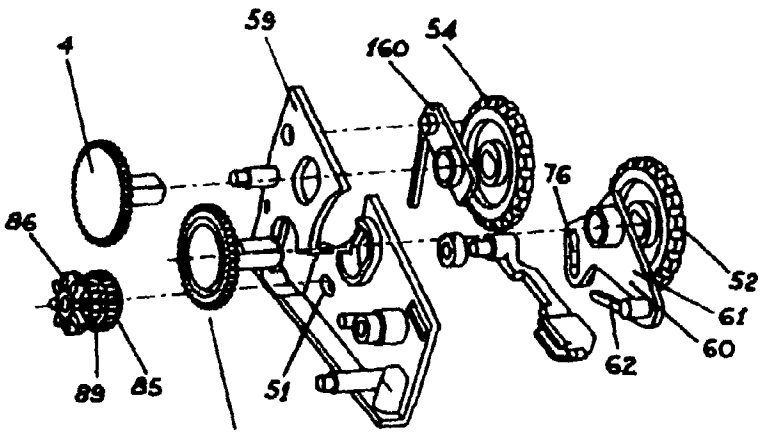
FIGS. 7 and 8 illustrate a detail of part of the setting mechanism shown in FIG. 3.
Figure 6:
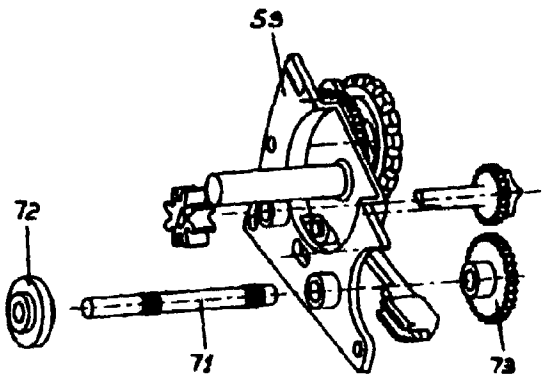
FIG. 6 is a different view of that part of the setting mechanism shown in FIG. 5.
Figure 8:
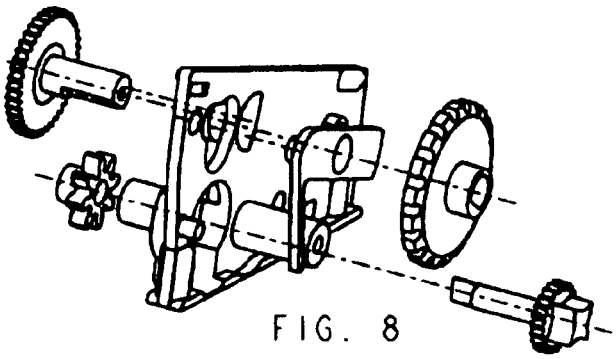
Figure 9:
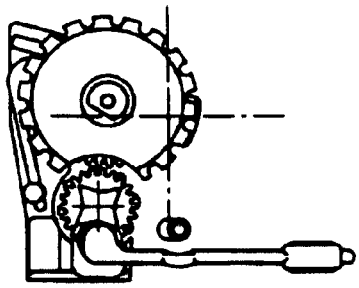
FIGS. 9 to 13 illustrate another part of the setting mechanism shown in FIG. 3.
Figure 10:
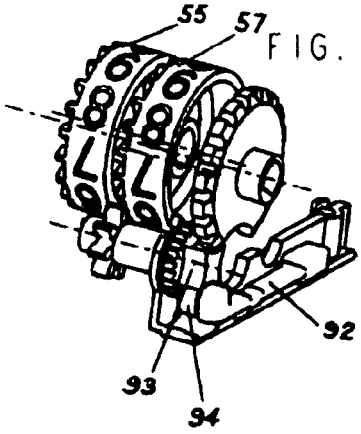
Figure 11:
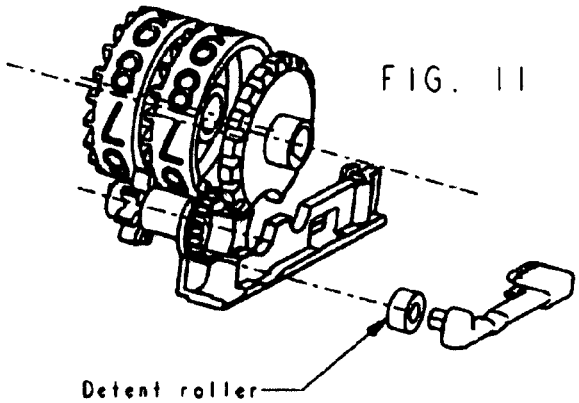
Figure 12:
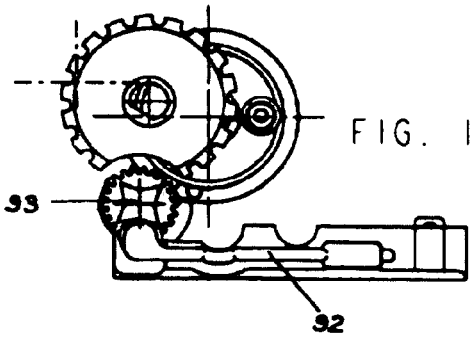
Figure 13:
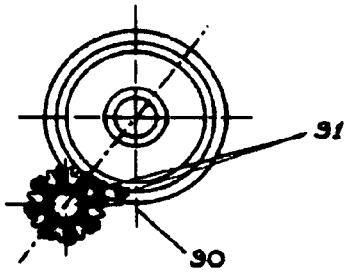
Figure 14:
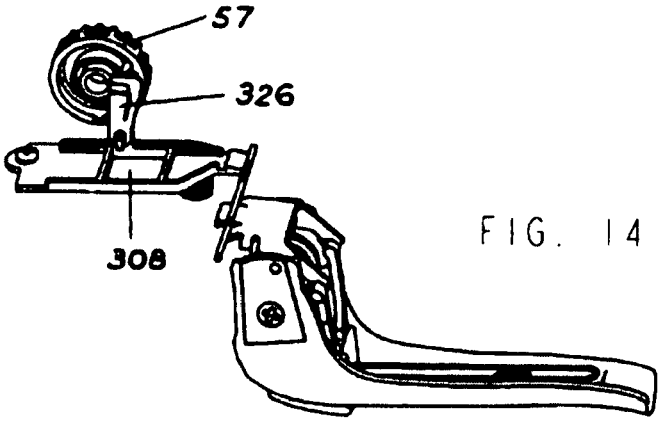
FIG. 14 is a perspective view of a latching mechanism forming part of the device shown in FIGS. 1 and 2.
Figure 15:
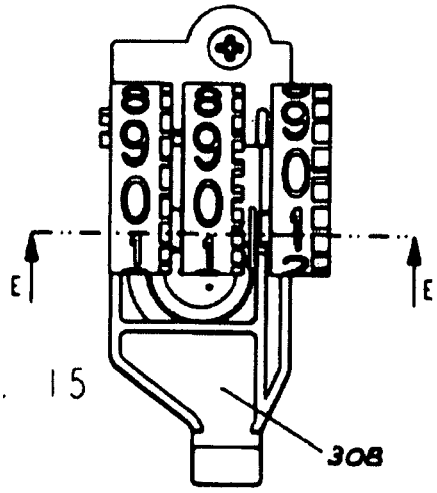
FIGS. 15 to 18 illustrate how the latching mechanism is triggered.
Figure 16:
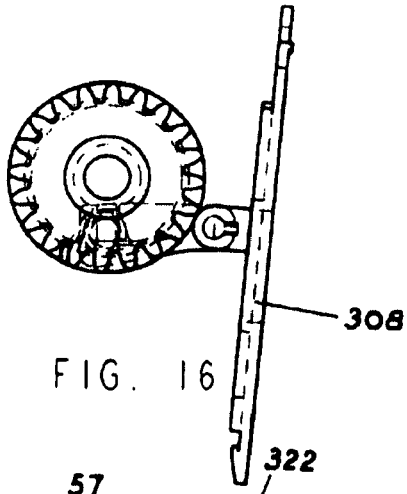
Figure 17:
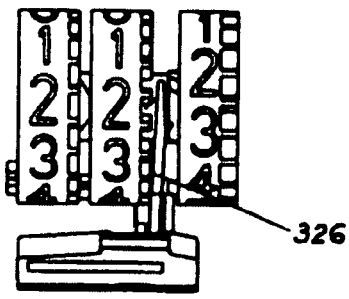
Figure 18:
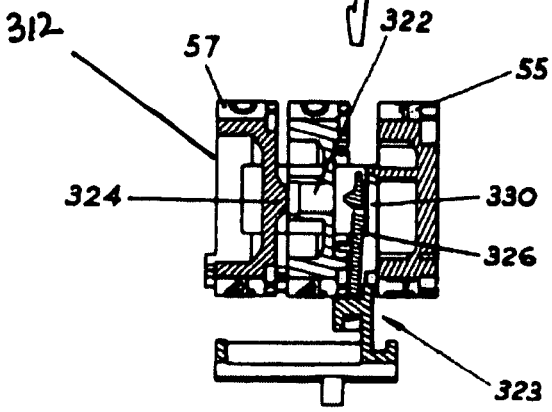
Figure 19:
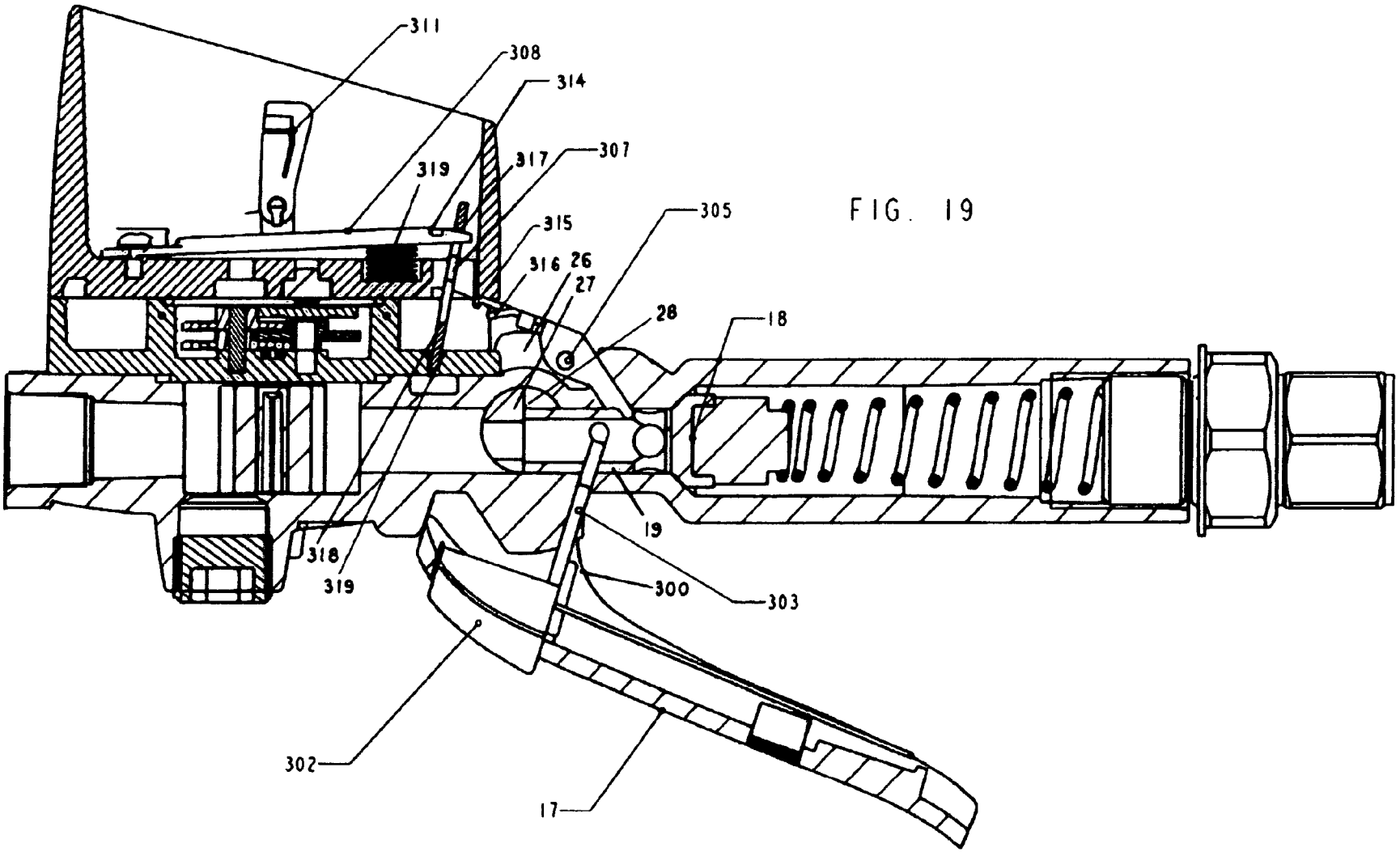
FIGS. 19 to 23 illustrate the operation of the latching and triggering mechanisms.
Figure 20:
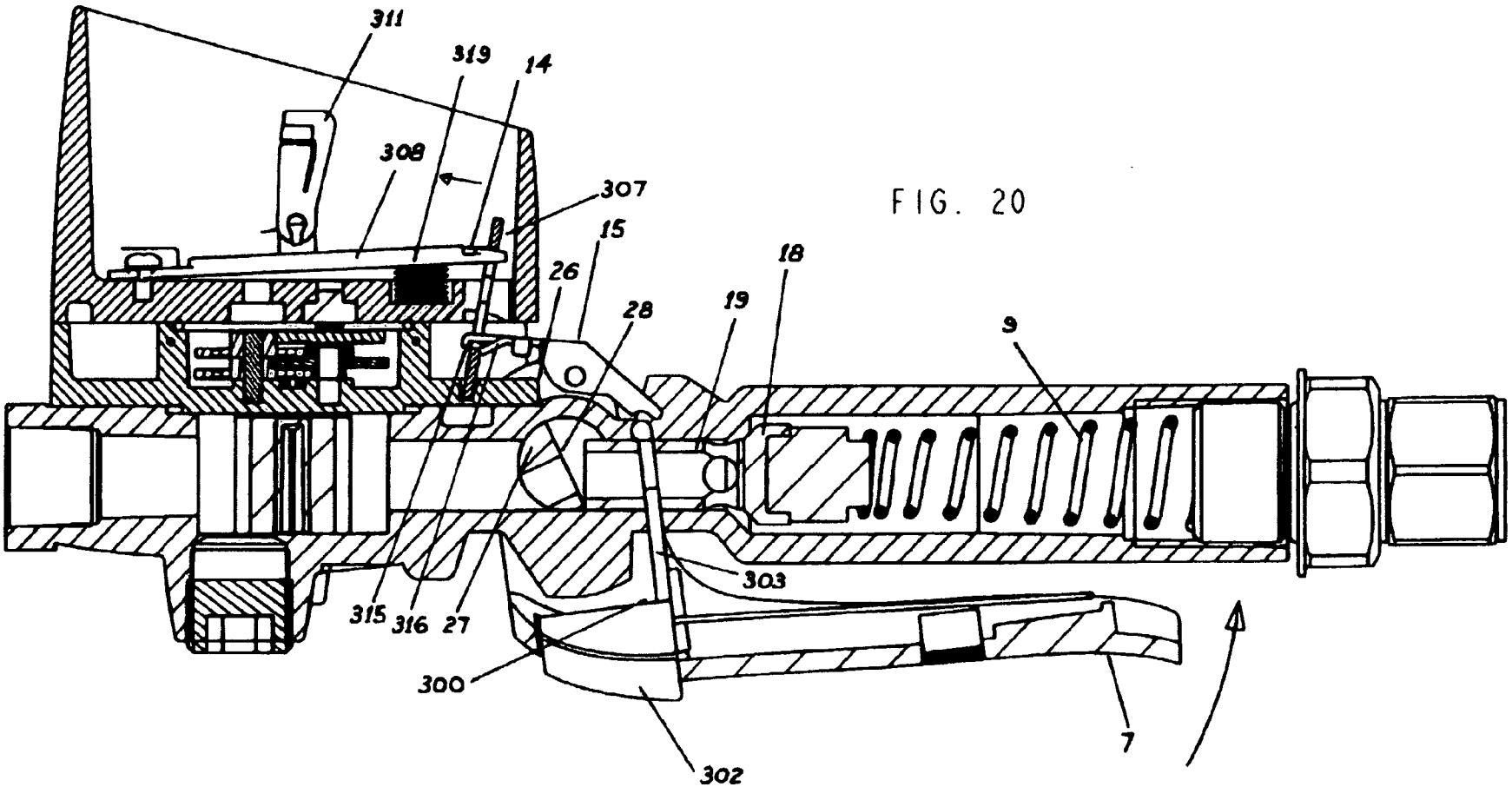
Figure 21:
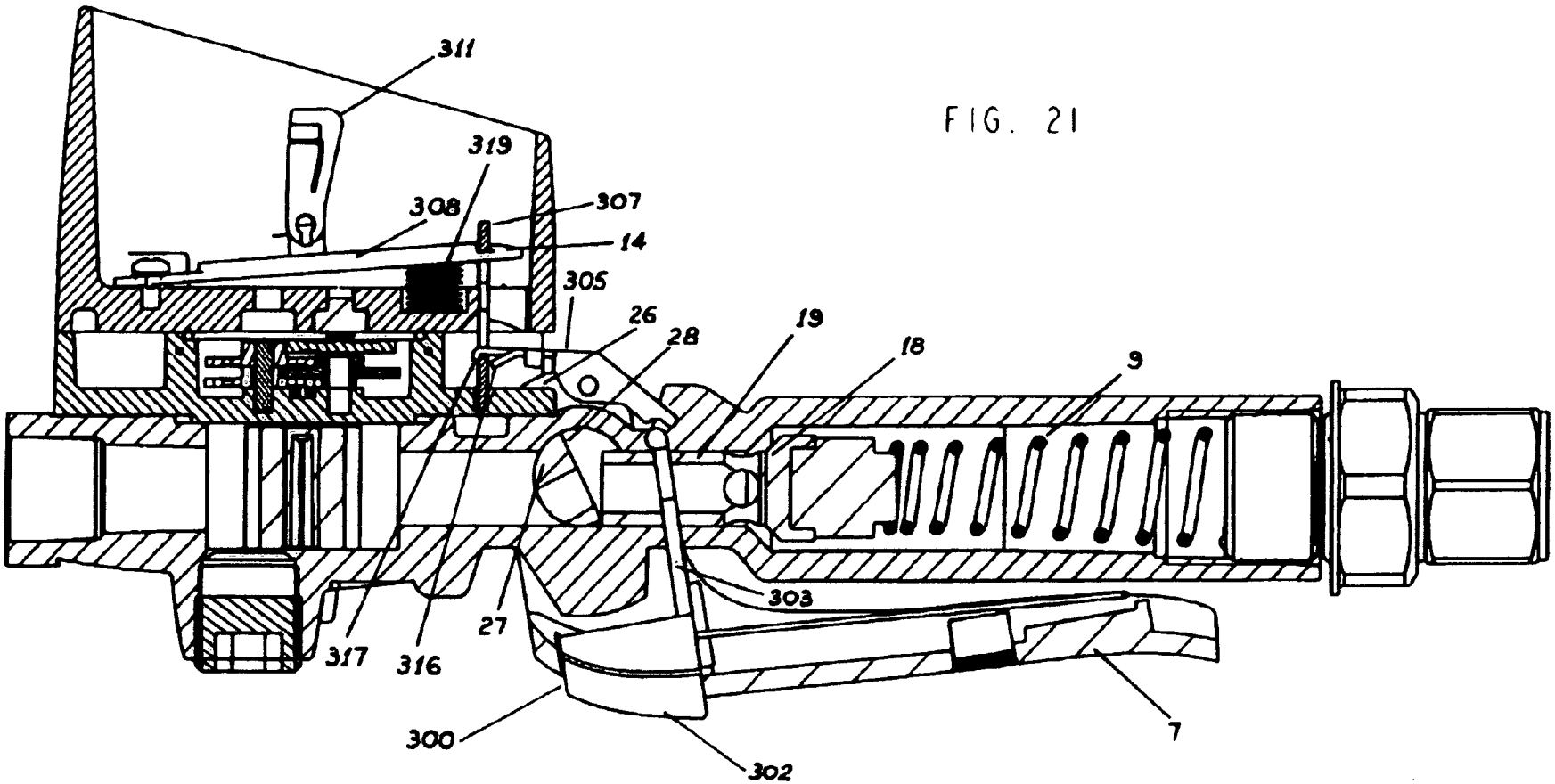
Figure 22:
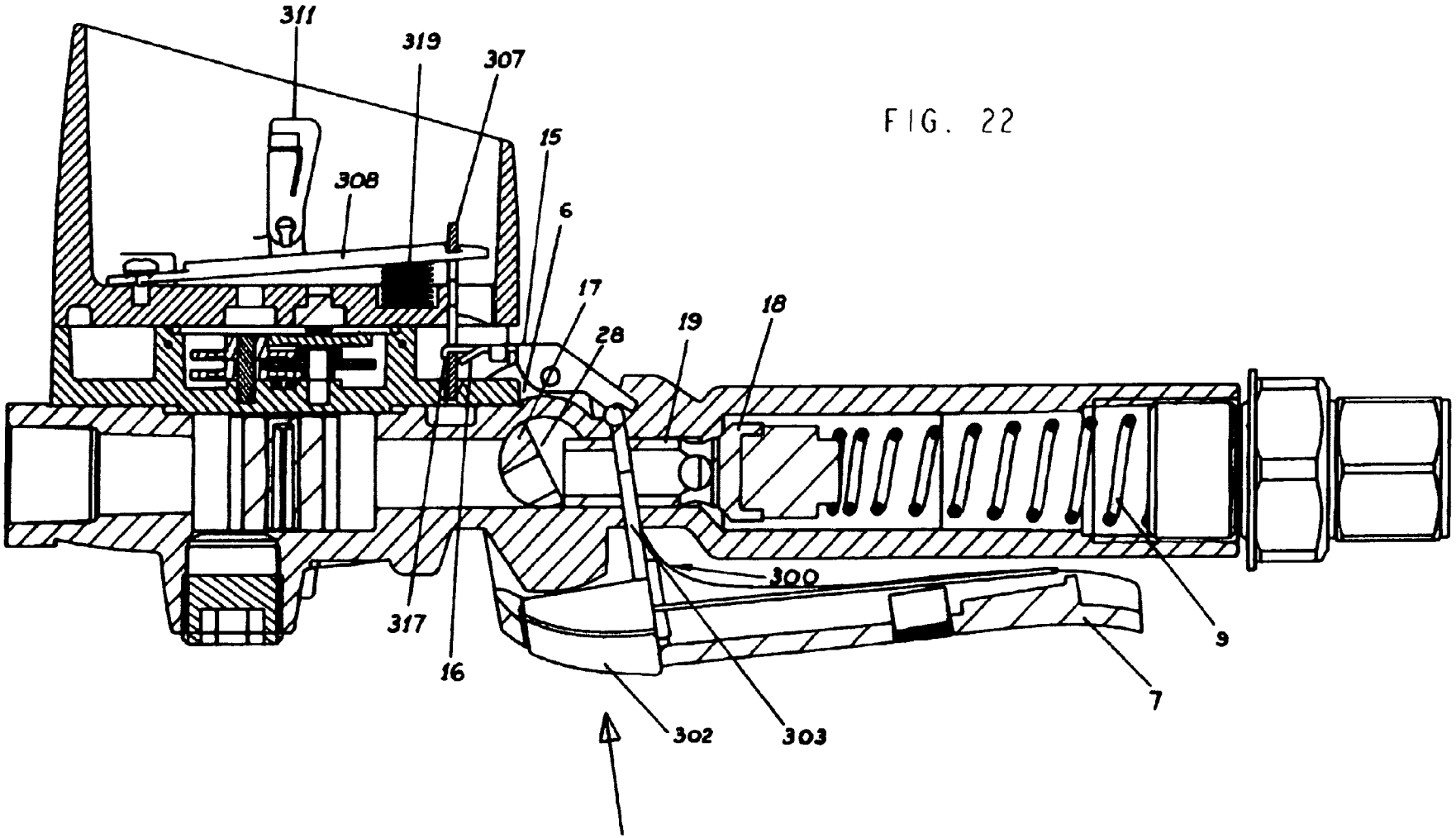
Figure 23:
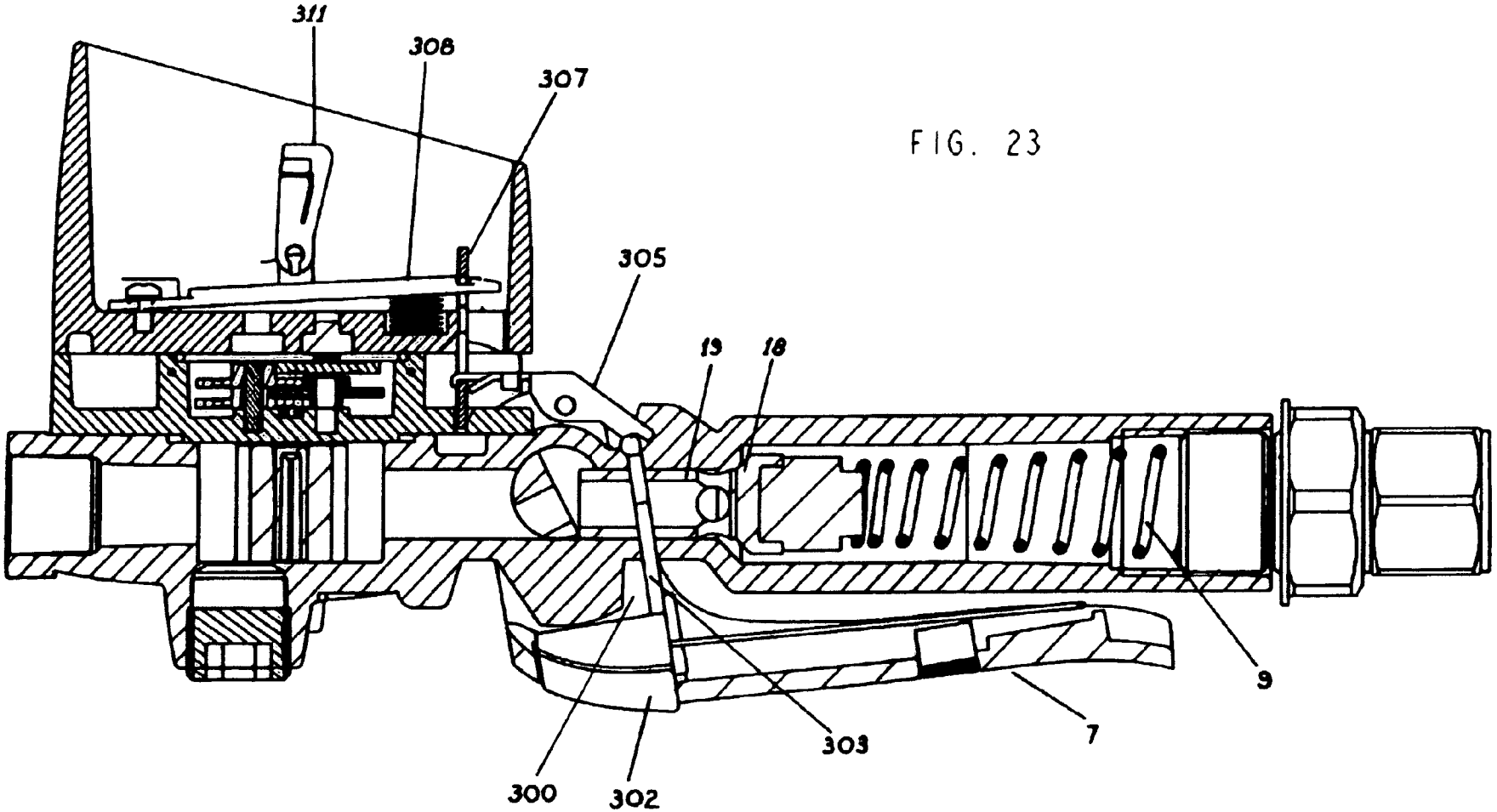

Referring to FIGS. 3(*a*) and 3(*b*) of the drawings there is shown a setting mechanism 50 for setting and displaying a selected volume of fluid to be dispensed through the meter 20. The setting mechanism 50 comprises first, second and third setting wheels 52, 54 and 56. Each setting wheel is mounted for movement between an engaged position and a disengaged position. In the engaged position each setting wheel is operatively connected to a respective one of the display wheels 53, 55 and 57 with which it is associated via individual gear trains. In the particular application described the first display wheel 53 displays tenths, the second display wheel 55 displays units, and the third display wheel 57 displays decades, in relation to volume units of fluid dispensed through the control meter 20. The various components of the mechanism are operatively connected directly or indirectly to a support frame which includes first and second mounting plate sections 58 and 59. As best seen in FIGS. 5 to 7 mounting plate section 59 comprises two parts. The mechanism includes an input transmission assembly 70 which includes an input shaft 71 and a bevel gear 72 which is operatively connected to the control meter 20 through calibrating gear box 22. The interconnection between the control meter 20 and input assembly 70 is best seen in FIGS. 2(*a*) and 2(*b*). The control meter 20 is connected to the calibrating gear box 22 having an output shaft 32 to which a bevel gear 34 is mounted. Bevel gear 34 is in engagement with bevel gear 72 of the input transmission assembly 70. The input transmission assembly 70 further includes an input gear 73 which is operatively connected to a first gear train. The display wheels 53, 55, 57 are carried on a support shaft 74 which extends between mounting plate sections 58 and 59.

The first setting wheel 52 is operatively connected to display wheel 53 via the first gear train which will be described in more detail below. In the disengaged position it is disconnected from the gear train. To this end the setting wheel 52 is mounted to a spring biased pivot member 60 and arranged such that depression of the wheel 52 causes pivotal movement of the pivot member 60 so that the setting wheel will adopt the engaged position wherein it is in operative connection with the display wheel 53 via the first gear train. This is best seen in FIGS. 3(*b*), 5 and 7. The pivot member 60 includes a mounting leg 61 to which the first setting wheel is rotatably mounted and a spring leg 62 which in the assembled position abuts against a stop 63. (FIG. 3(*b*)). Manual depression of the first setting wheel 52 causes partial rotation of pivot member 60 against the action of spring leg 62 so that the wheel 52 engages the first gear train.

The first gear train includes a thumb gear 84 which is operatively connected to the setting wheel 52 for rotation therewith and is connectable with an idler drive gear 85 operable to drive an idler gear 86 which in turn engages a gear section 79 of a display wheel 53. The drive gear 85 and idler gear 86 are mounted on an idler gear shaft 87. The idler gear shaft 87 is mounted at a pivot mounting 88 on plate 58 for limited pivotal movement for reasons which will become hereinafter apparent. The other end of the shaft 87 is received within slots 51, 76 and 77 in frame 59 and pivot member 60.

The idler drive gear section 89 is in meshing engagement with input gear 73. When setting wheel 52 is depressed, thumb gear 84 moves into meshing engagement with idler drive gear 85 and depression into its extreme position causes disengagement of input gear 73 from idler drive gear section 89. When depressed, rotation of setting wheel 52 will cause rotation of display wheel 53 so that it can be set at a selected unit of volume.

The second setting wheel 54 is operatively connected to display wheel 55 via a second gear train. The second setting wheel 54 is mounted to a pivot member 160 which is mounted to mounting plate 59 and operates in a similar fashion to the pivot member 60 so that the setting wheel can be disengaged from the second gear train.

The second gear train includes a thumb gear 184 which is directly connected to the setting wheel 54. The gear train further includes an idler drive gear and idler gear which engages a gear section 179 on display wheel 55. The structure of the second gear train is substantially the same as that of the first gear train. The second setting wheel 54 and its associated gear train do not engage directly with the input transmission assembly 70 at any time.

Figure 4:
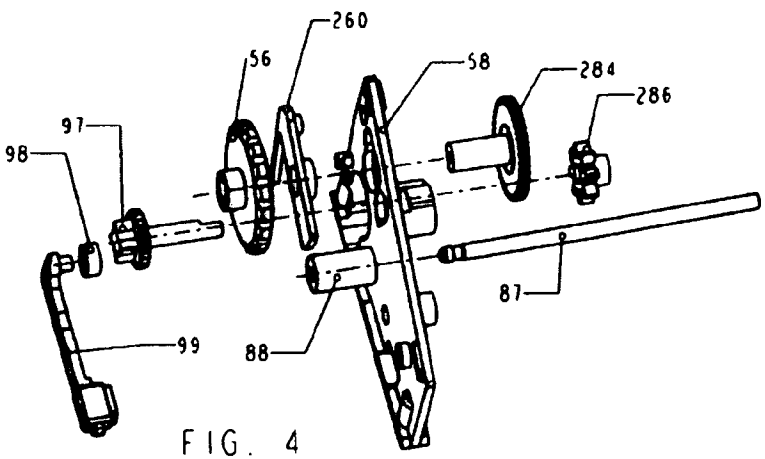
FIG. 4 is a detail of part of the setting mechanism shown in FIG. 3.

The arrangement of the third setting wheel 56 is similar to those described above and is best seen in FIG. 4. Again there is an operative connection between the third setting wheel 56 and third display wheel 57 via a third gear train. The third setting wheel 56 is mounted to a pivot member 260 mounted to plate 58.

The structure and operation of pivot member 260 is the same as the pivot members 60 and 160 described earlier. The third gear train includes a thumb gear 284 which is directly connected to the setting wheel 57. The third gear train further includes an idler drive gear 285 and an idler gear 286. The display wheel has a gear section 297 wheel is in meshing engagement with idler gear 286. The third gear train does not directly engage with the input transmission assembly 70 at any stage.

A first indexing arrangement is provided between the first and second display wheels 53 and 55 and a second indexing arrangement is provided between the second and third display wheels 55 and 57 in order to provide for correct timing between the two associated display wheels. The first indexing arrangement includes an indexing element 90 in the form of two gear teeth 91 adapted to be engaged by the drive gear 185 of the second gear train. The second indexing arrangement includes an indexing element comprising two gear teeth on the second display wheel. Each arrangement further incudes a locating device comprising a detent cam 93 and 97 which cooperate with a follower 94 and 98 on spring arm 92 and 99 ensure that the display wheels are correctly indexed with respect to one another.

The setting mechanism enables a preselected volume of fluid required to be dispensed to be displayed on the display wheels. When the trigger 17 of the device is activated to open valve 18 the volume of fluid passing through the device drives the valve control meter which in turn drives the calibrating gear which in turn drives the input transmission assembly 70 causing the display wheels to rotate in volume display descending fashion. The display wheel 52 is directly connected to transmission assembly 70. Each revolution of the display wheel 52 will cause engagement between that wheel and wheel 54 through the indexing mechanism associated therewith causing rotation thereof each time the indexing mechanism engages. The wheel 54 and wheel 56 will operate in a similar manner to that of wheel 52 and 54 until a reading is reached whereby the latching mechanism is triggered.

The Latch Mechanism

The latch mechanism includes a latch setting assembly 300 associated with trigger 17 of the dispensing device which is operable to set the latch mechanism when the trigger 17 is depressed and in the second position. The latch setting assembly 300 includes a setting button 302 mounted on the trigger 17, and a connector arm 303 operatively connected to the button 302.

The latch mechanism further includes a first catch assembly comprising a control member 305 which is pivotally mounted to a part of the body portion 26 of the trigger 17. The control member 305 includes a catch 315 and push element 316 adapted to cooperate with a latch member 307. A spring (not shown) urges the control member 305 into the position shown in FIG. 19. The latch member 307 is in the form of a latch plate pivotally mounted to the housing at pivot mounting 319. The latch member 307 includes first and second latching sections 317 and 318 defined by shoulders formed as edges of apertures in the latch plate.

The latch mechanism may further include a second catch assembly comprising a catch member 308 having a catch 314 thereon is operatively connected to a trip assembly 312. A spring 319 acts on catch member 308 as shown.

The trip assembly 312 includes a trip pin 322 actuatable by a boss 324 on the display wheel 57. A coupling member 326 is caused to be moved by the trip pin 322 whereupon it is engaged by activating projection 330 on display wheel 55.

The latching mechanism is operable so as to be able to adopt a latched position in which position the valve 18 of the dispensing device is open and a release position in which the valve 18 can return to a closed position. Preferably the trigger 17 can be activated to cause the valve to open whether or not the latch mechanism is in the latched position.

To set the latching mechanism the trigger 17 is depressed. This causes rotation of the shaft 27 and cam surface 28 which acts on the valve follower 19 to cause the valve 18 to open. The rotational movement of the trigger body 27 moves the control member 305 into engagement with the latch plate 307. The latch plate 307 is pivotal about its pivot mounting 319 causing the catch 314 to engage with first latching section 317 on latch plate 307. At this stage the catch 315 is not engaged with latching section 318 and the trigger 17 can return to its first position under the influence of the spring (not shown) described earlier.

To set the trigger 17 it is moved to its second position causing a pivotal movement of the control member 308 and depression of the button 302 causes arm 303 to engage the end of the control member 308 so that the catch 315 engages latching section 318 thereby holding the trigger in the second position.

In the embodiment shown, the setting mechanism enables a volume to be set correlating to three display wheels. For example, the device can be set to read tenth increments, unit increments and decade increments. The selected volume is set by pressing and rotating to the selected reading each of the thumb wheels each of which is associated with a respective display wheel. When moved the thumb wheels disengage from the other wheels so that they can be separately set without interference from the other wheels. All wheels can be rotation in both directions.

When the trigger is moved to the second position and the latch mechanism set fluid can flow through the meter and the display wheels will rotate counting down towards zero. When the meter reaches zero the valve latch is released and the flow stops.

Finally, it is to be understood that various alterations, modifications and/or additions may be incorporated into the various constructions and arrangements of parts without departing from the spirit or ambit of the invention.

The invention claimed is:

1. A fluid dispensing device including a shut off valve, a fluid flow control assembly for controlling fluid flow through the device and an actuating trigger operable to cause the shut off valve to adopt an open position in which fluid can be dispensed from the device and a closed position, a control meter which enables the volume of fluid being disposed to be measured, a latching mechanism operable to hold the shut off valve in the open position and cause the shut off valve to adopt the closed position when the predetermined volume of fluid has been dispensed, a setting mechanism operatively connected to the control meter for indicating a predetermined volume of fluid required to be dispensed and indicating when that predetermined volume has been dispensed the setting mechanism including a plurality of display wheels which can indicate the predetermined quantity of fluid to be dispensed, the display wheels being operatively connected to the control meter so that the flow of fluid through the control meter can be displayed on the display wheels, the arrangement being such that when the shut off valve is in the closed position the display wheels can be adjusted to indicate the predetermined quantity of fluid to be dispensed and when the shut off valve is opened the display wheels can indicate when the predetermined volume has been dispensed, the setting mechanism further including a plurality of setting wheels each setting wheel being associated with a respective one of the display wheels, each setting wheel being operatively connectible with the display wheel with which it is associated via a gear train, each setting wheel being mounted for movement between an engaged position and a disengaged position.

2. A fluid dispensing device according to claim 1 wherein, in the engaged position each setting wheel is operatively connected to the display wheel with which it is associated via the gear train so that rotation of the setting wheel causes rotation of the display wheel with which it is associated, and in the disengaged position the setting wheel is disconnected from the display wheel with which it is associated and may be freely rotatable.

3. A fluid dispensing device according to claim 2 wherein the setting mechanism includes a support frame to which the setting wheels and display wheels are operatively mounted.

4. A fluid dispensing device according to claim 3 wherein each setting wheel is operatively mounted to a pivot member which is pivotally connected to the support frame, so that pivotal movement of the pivot member causes movement of the setting wheel between the engaged and disengaged positions.

5. A fluid dispensing device according to claim 4 further including a spring for urging each setting wheel into the disengaged position, the spring comprising a generally resilient leg on the pivot member.

6. A fluid dispensing device including a shut off valve means, a fluid flow controller for controlling fluid flow through the device and an actuating trigger operable to cause the shut off valve to adopt an open position in which fluid can be dispensed from the device and a closed position, a control meter which enables the volume of fluid being disposed to be measured, a setting mechanism being operatively connected to the control meter for indicating a predetermined volume of fluid required to be dispensed and indicating when that predetermined volume has been dispensed, a latching mechanism operable to hold the shut off valve in the open position and cause the shut off valve to adopt the closed position when the predetermined volume of fluid has been dispensed, the latching mechanism including a latch setting assembly for setting the actuating trigger of the device so that the shut off valve is in the open position, a trip assembly which is actuatable at a preselected display on the display wheels of the setting mechanism, a first catch assembly operable so as to adopt an engaged position or a disengaged position and arranged such that actuation of the trip assembly causes the first catch assembly to adopt the disengaged position, and a second catch assembly which can adopt an engaged position when the actuator trigger of the device is in an actuating position in which the shut off valve is open, the first catch assembly adopting the engaged position when the actuator trigger is moved to the actuating position and further including a setting button mounted on the actuator trigger, and a connector arm operatively connected to the button.

7. A fluid dispensing device according to claim 6 wherein the first catch assembly includes a control member which is pivotally mounted to a part of the body portion of the trigger, the control member including a catch and push element adapted to cooperate with a latch member, the latch member comprising a latching plate pivotally mounted to the housing at a pivot mounting, the catch assembly including first and second latching sections defined by shoulders formed as edges of apertures in the latching plate.

8. A fluid dispensing device according to claim 7 wherein the second catch assembly includes a catch member having a catch thereon which is operatively connected to a trip assembly.

9. A fluid dispensing device according to claim 8 including a spring adapted to act on the catch member.

10. A fluid dispensing device according to claim 9 wherein the trip assembly includes a trip pin actuatable by a boss on one of the display wheel and a coupling member which is caused to be moved by the trip pin whereupon it is engaged by an activating projection on another display wheel.

11. A setting mechanism suitable for use in a fluid dispensing device the fluid dispensing device including a shut off valve, a fluid flow control assembly for controlling fluid flow through the device and an actuating trigger operable to cause the shut off valve to adopt an open position in which fluid can be dispensed from the device and a closed position, a control meter which enables the volume of fluid being disposed to be measured, a latching mechanism operable to hold the shut off valve in the open position and cause the shut off valve to adopt the closed position when the predetermined volume of fluid has been dispensed, the setting mechanism being operatively connected to the control meter for indicating a predetermined volume of fluid required to be dispensed and indicating when that predetermined volume has been dispensed and including a plurality of display wheels which can indicate the predetermined quantity of fluid to be dispensed, the display wheels being operatively connected to the control meter so that the flow of fluid through the control meter can be displayed on the display wheels, the arrangement being such that when the shut off valve is in the closed position the display wheels can be adjusted to indicate the predetermined quantity of fluid to be dispensed and when the shut off valve is opened the display wheels can indicate when the predetermined volume has been dispensed, the setting mechanism further including a plurality of setting wheels each setting wheel being associated with a respective one of the display wheels, each setting wheel being operatively connectible with the display wheel with which it is associated via a gear train, each setting wheel being mounted for movement between an engaged position and a disengaged position.

12. A setting mechanism according to claim 11 wherein, in the engaged position each setting wheel is operatively connected to the display wheel with which it is associated via the gear train so that rotation of the setting wheel causes rotation of the display wheel with which it is associated, and in the disengaged position the setting wheel is disconnected from the display wheel with which it is associated and may be freely rotatable.

13. A setting mechanism according to claim 12 wherein the setting mechanism includes a support frame to which the setting wheels and display wheels are operatively mounted.

14. A setting mechanism according to claim 13 wherein each setting wheel is operatively mounted to a pivot member which is pivotally connected to the support frame, so that pivotal movement of the pivot member causes movement of the setting wheel between the engaged and disengaged positions.

15. A setting mechanism according to claim 14 further including a spring for urging each setting wheel into the disengaged position, the spring comprising a generally resilient leg on the pivot member.

16. A latching mechanism suitable for use in a fluid dispensing device, the fluid dispensing device including a shut off valve means, a fluid flow controller for controlling fluid flow through the device and an actuating trigger operable to cause the shut off valve to adopt an open position in which fluid can be dispensed from the device and a closed position, a control meter which enables the volume of fluid being disposed to be measured, and a setting mechanism being operatively connected to the control meter for indicating a predetermined volume of fluid required to be dispensed and indicating when that predetermined volume has been dispensed, the latching mechanism operable to hold the shut off valve in the open position and cause the shut off valve to adopt the closed position when the predetermined volume of fluid has been dispensed, the latching mechanism including a latch setting assembly for setting the actuating trigger of the device so that the shut off valve is in the open position, a trip assembly which is actuatable at a preselected display on the display wheels of the setting mechanism, a first catch assembly operable so as to adopt an engaged position or a disengaged position and arranged such that actuation of the trip assembly causes the first catch assembly to adopt the disengaged position, and a second catch assembly which can adopt an engaged position when the actuator trigger of the device is in an actuating position in which the shut off valve is open, the first catch assembly adopting the engaged position when the actuator trigger is moved to the actuating position and further including a setting button mounted on the actuator trigger, and a connector arm operatively connected to the button.

17. A latching mechanism according to claim 16 wherein the first catch assembly includes a control member which is pivotally mounted to a part of the body portion of the trigger, the control member including a catch and push element adapted to cooperate with a latch member, the latch member comprising a latching plate pivotally mounted to the housing at a pivot mounting, the catch assembly including first and second latching sections defined by shoulders formed as edges of apertures in the latching plate.

18. A latching mechanism according to claim 17 wherein the second catch assembly includes a catch member having a catch thereon which is operatively connected to a trip assembly.

19. A latching mechanism according to claim 18 including a spring adapted to act on the catch member.

20. A latching mechanism according to claim 19 wherein the trip assembly includes a trip pin actuatable by a boss on one of the display wheel and a coupling member which is caused to be moved by the trip pin whereupon it is engaged by an activating projection on another display wheel.

* * * * *